US006073411A

United States Patent [19]

Ciccarello

[11] Patent Number: 6,073,411

[45] **Date of Patent: *Jun. 13, 2000**

[54] PRE-CAST RECTANGULAR COBBLESTONE

[75] Inventor: Charles Ciccarello, Brossard, Canada

[73] Assignee: Techo-Bloc Inc., St. Hubert, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/946,075

[22] Filed: Oct. 7, 1997

[51] Int. Cl.[7] ..... E01C 5/00

[52] U.S. Cl. ..... 52/589.1; 52/591.1; 52/591.3; 52/592.2; 404/41

[58] Field of Search ..... 52/102, 311.2, 52/605, 589.1, 591.3, 592.2, 608; 404/29, 30, 42, 41

[56] References Cited

U.S. PATENT DOCUMENTS

| | | | |
|---|---|---|---|
| 1,479,647 | 1/1924 | Carroll | 52/564 X |
| 4,627,764 | 12/1986 | Scheiwiller | 52/314 X |
| 4,761,095 | 8/1988 | Bartlechner | 52/605 X |
| 4,792,257 | 12/1988 | Rinninger | 52/384 X |
| 4,907,909 | 3/1990 | Ruckstuhl | 404/37 |
| 5,348,417 | 9/1994 | Scheiwiller | 404/41 |
| 5,533,827 | 7/1996 | Scheiwiller | 404/38 |
| 5,615,971 | 4/1997 | Boeve | 52/102 X |
| 5,645,369 | 7/1997 | Geiger | 404/34 |
| 5,735,643 | 4/1998 | Castonguay et al. | 52/606 X |
| 5,797,698 | 8/1998 | Barth et al. | 404/39 |

FOREIGN PATENT DOCUMENTS 35 07 226 C2 3/1991 Germany .

*Primary Examiner*—Richard Chilcot
*Attorney, Agent, or Firm*—Swabey Ogilvy Renault; Guy J. Houle

[57] ABSTRACT

A pre-cast cobblestone (10) is comprised of a concrete body (11) of substantially rectangular outline and having a top and bottom wall (13–14) and opposed side walls (15). The top wall (13) is embossed and the side walls (15) have longitudinally shaped flat side surfaces (15'). At least two of the side walls have spaced-apart protruding sections (16–17, 18–19) of irregular transverse cross-section which are aligned with straight intersecting outer parallel axes (12–12') of the side walls. The side walls (15) also have recessed sections (19) of irregular transverse cross-section defined between the protruding sections. When the cobblestones (10) are laid on a support surface in substantially straight aligned relationship to define a pavement (22), they are offset end-to-end and irregularly interlocked by some of the protruding sections (16, 17, 18, 19) of some of the cobblestones entering into the irregular recessed sections (19) of other of the cobblestones to prevent shifting of the cobblestones in the pavement (22).

3 Claims, 2 Drawing Sheets

PRE-CAST RECTANGULAR COBBLESTONE

TECHNICAL FIELD

The present invention relates to a pre-cast cobblestone of substantially rectangular outline and having irregular longitudinally-shaped flat side surfaces to define protruding sections and recessed sections and to form irregular open crevices when the cobblestones are laid side-by-side.

BACKGROUND ART

Most pre-cast cobblestones heretofore known have been formed as roundish-shaped stones. Others, such as described in German Patent Application DE 35 07 226 C2, published Mar. 14, 1991, disclose a two-tier cobblestone which comprises a base of substantially rectangular cross-section having rounded corners and parallel side walls and on top of which is recessed a cobblestone-like top section. The stones are laid side-by-side and in offset relationship with their flat surfaces touching longitudinally. A drain channel is formed in one of the side walls. Such stones are easily laid on a flat bed surface because their side walls and end walls are flat and the stones perfectly align with their side surfaces in facial contact. However, when a pavement is laid, it does not closely resemble real cobblestones but the usual pavement stones that are well known in the art and wherein all the stones resemble one another as the cobblestone recessed upper parts do not touch one another and are always separated by a uniform distance.

SUMMARY OF INVENTION

It is a feature of the present invention to provide a cobblestone of substantially rectangular outline but which resembles a real cobblestone and which, when laid, forms irregular open crevices therebetween extending throughout the thickness of the stone.

Another feature of the present invention is to provide a pre-cast substantially rectangular cobblestone permitting a plurality of such cobblestones to be laid on a support surface in substantially straight aligned relationship but offset end-to-end at irregular intervals and irregularly interlocked by some irregularly protruding sections and recess sections provided in the side walls of the cobblestones.

According to the above features, from a broad aspect, the present invention provides a pre-cast cobblestone comprising a concrete body of substantially rectangular outline and defining opposed top and bottom walls and opposed side walls. The bottom wall has a flat surface. The top wall has an embossed irregular surface. The opposed side walls have an irregular longitudinally shaped flat side surface. At least two of the side walls have spaced-apart protruding sections of irregular transverse cross-section which extend to straight intersecting outer parallel axes of the side walls. The side walls also have recessed sections of irregular transverse cross-section defined between the protruding sections. The outer parallel axes define a rectangular outer peripheral boundary of the concrete body whereby a plurality of the cobblestones can be laid on a support surface in substantially straight aligned relationship to define a pavement. The cobblestones are offset end-to-end at irregular intervals and irregularly interlocked by some of the protruding sections of some of the cobblestones entering into the irregular recessed sections of other of the cobblestones to prevent shifting of the cobblestones in the pavement.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
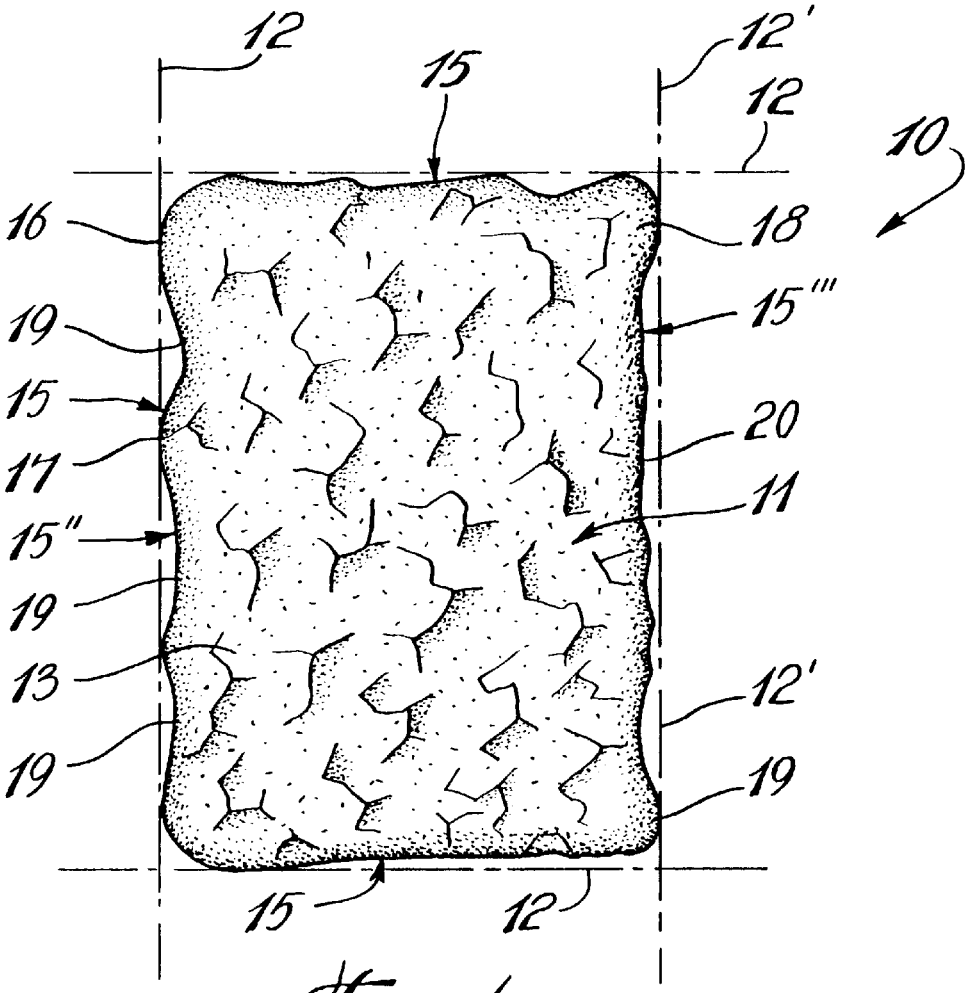
FIG. 1 is a top view of the pre-cast cobblestone of the present invention.
Figure 2:
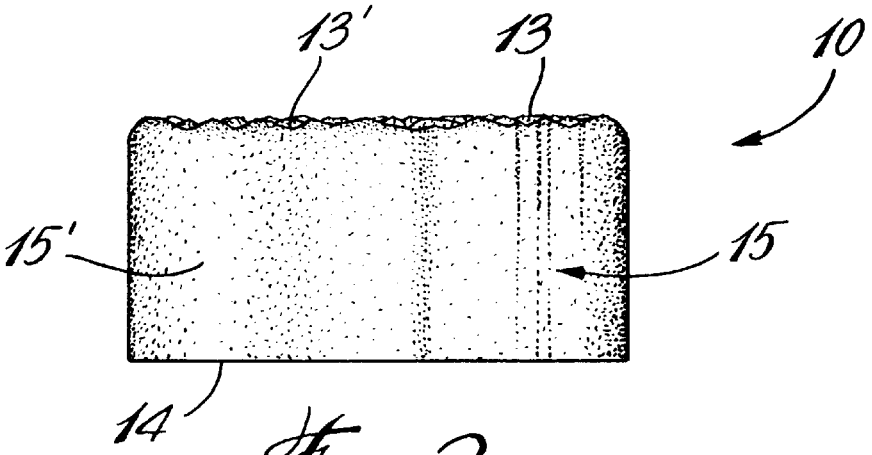
FIG. 2 is an end view of FIG. 1 showing the shape of a side wall.

Referring now to the drawings and more particularly to FIG. 1, there is shown generally at 10 the pre-cast cobblestone of the present invention. The cobblestone comprises a concrete body 11 of substantially rectangular outline as defined by the spaced-apart opposed parallel straight intersecting axes 12 and 12'. With further reference to FIG. 2 it can be seen that the concrete body 11 has a top wall 13 which has an embossed surface 13', and a flat bottom wall 14. The embossed surface 13' is of irregular shape to simulate a stone surface.

The opposed side walls 15 have an irregular longitudinally shaped flat side surface 15'. At least two of the side walls, for example as shown in FIG. 1, side wall 15" and side wall 15''' have spaced apart protruding sections 16 and 17 in side wall 15", and 18 and 19 in side wall 15'''. These protruding sections are of irregular transverse cross-section and project to respective straight intersecting outer parallel axes 12 for side wall 15" and 12' for side wall 15'''.

The side walls also define recess sections such as sections 19 in side wall 15" and 20 in side wall 15''' which are also of irregular transverse cross-section. The recess sections are recessed from the straight intersecting outer parallel axes 12.

Figure 3:
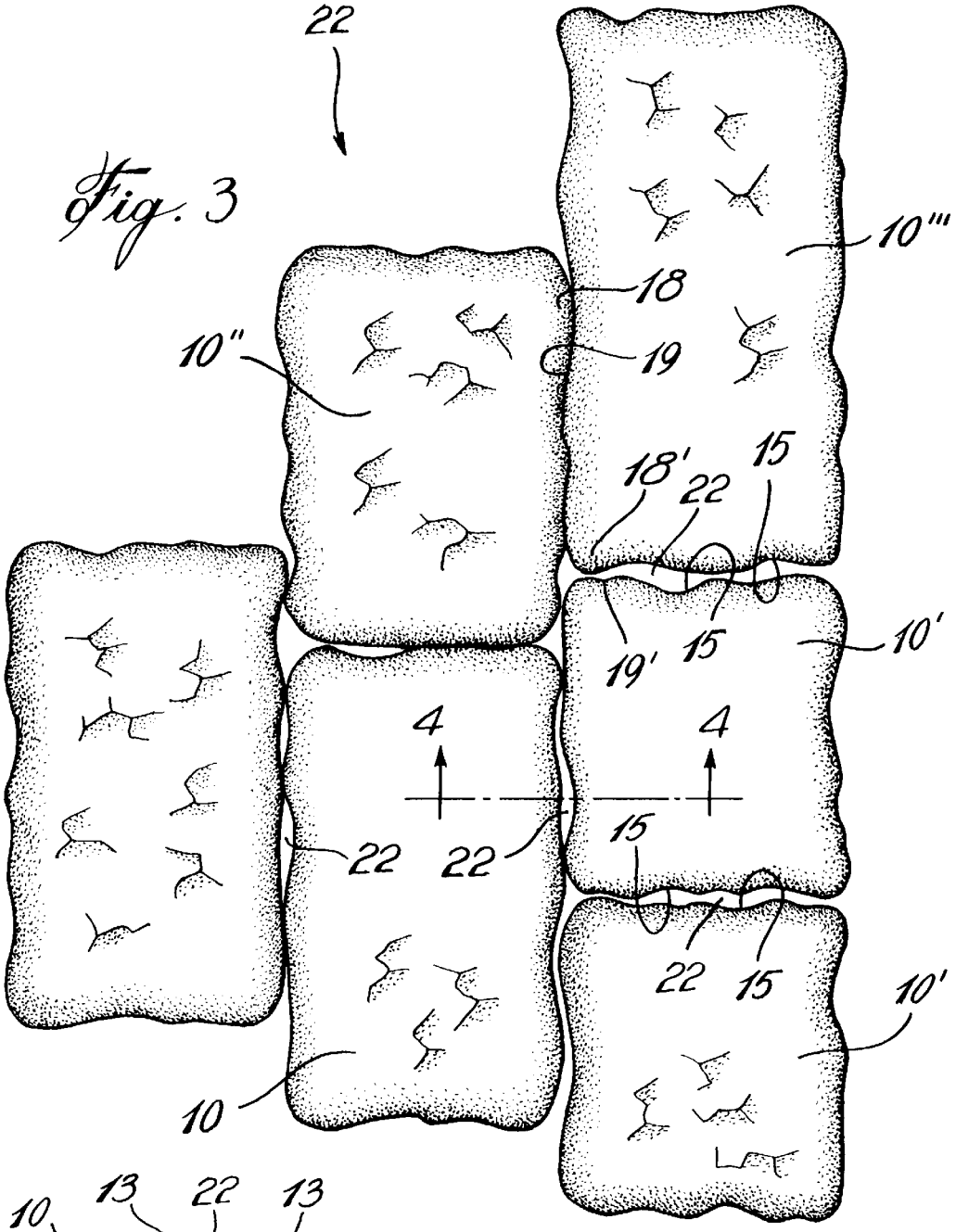
FIG. 3 is a top view showing a plurality of cobblestones of the present invention laid on a support surface to form a pavement and wherein cobblestones are laid in substantially straight aligned relationship and offset end-to-end at irregular intervals to form a pavement.
Figure 4:
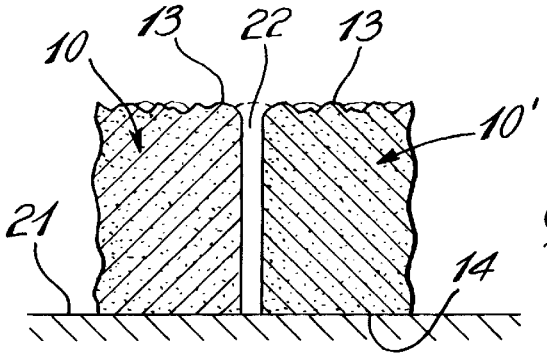
FIG. 4 is a section view along section lines IV—IV of FIG. 3.

With reference now to FIGS. 3 and 4, there is shown a plurality of pre-cast cobblestones 10 which are laid on a support surface 21 as shown in FIG. 4 in substantially straight aligned relationship to define a pavement 22. As can be seen the cobblestones, such as cobblestone 10' and 10", are offset end-to-end at irregular intervals and are irregularly interlocked by some of the protruding sections of some of the cobblestones entering into the irregular recess sections of other of the cobblestones to prevent shifting of the cobblestones in the pavement 22. It is pointed out that the cobblestones of different sizes have opposed surfaces of different shape and can be laid in opposed directions to give an impression that two identical stones are different. That is to say two like size stones are laid with opposed ends in mating relationship and positioned at irregular intervals or spacing with respect to adjacent cobblestones.

As shown in FIG. 3, the protrusion 18 of cobblestone 10" has entered a recess section 19 of cobblestone 10'''. The protruding section 18' of cobblestone 10''' has also entered into a recessed section 19' of cobblestone 10'. When the cobblestones are laid side-by-side, irregularly shaped open crevices 22 are formed between the side walls 15 of the cobblestones. These crevices, shown in FIG. 4, extend from the top wall 13 of the cobblestones to their bottom wall 14. These crevices can be filled with sand or earth to permit growth of grass, if desirable, whereby to simulate a real cobblestone pavement such as to form pathways or parking surfaces and even streets. Of course, such cobblestones may have a variety of other uses as is customary in landscaping architecture. It is also pointed out that the protruding sections may be formed in at least three of the side walls or all of the side walls although it is essential that they be formed in at least two of the side walls, as well as the recess sections whereby to achieve interlocking to prevent shifting.

As shown in FIG. 3, there are four different sizes of cobblestones and they all have a constant width and thickness but vary solely in the length thereof. The dimension of the cobblestone as described herein has a width of 144 mm and varying lengths of 160 mm, 200 mm, 240 mm and 280 mm, respectively.

Because the cobblestones have flat side walls but of irregular shape to define protruding sections and recess sections, they are easily molded like the conventional pavement block. However, their irregular shape is so designed as to permit interlocking and the formation of irregular open crevices whereby to simulate real cobblestones but of substantially rectangular outline. The crevices also serve as drainage cavities between the stones. It is also pointed out that because the cobblestones are of substantially rectangular outline they are quite easy to install although the stones may need to be turned around in order to position protruding sections into recess sections depending on the offset relationship of the stones.

It is again pointed out that it is not essential with the pre-cast cobblestone of this invention to lay them in a fixed pattern as these are laid much like the real cobblestones in random arrangement as well as in pattern arrangements. However, unlike the real cobblestone there is no need to chisel the pre-cast cobblestone to form fits and accordingly unskilled labor may be used to perform the installation with very little training. The result is that pavements can be produced with irregular surface appearances. In the process of manufacturing, the pre-cast cobblestones are also tumbled whereby to give them the worn stone-like appearance.

It is within the ambit of the present invention to cover any obvious modifications of the preferred embodiment described herein, provide such modifications fall within the scope of the appended claims.

What is claimed is:

1. A pre-cast cobblestone for use in combination with different sizes of said cobblestones for constructing a pavement, each cobblestone having a constant width and thickness and varying solely in length, comprising a concrete body of substantially rectangular outline and defining opposed top and bottom walls and opposed side walls, said bottom wall having a flat surface, said top wall having an embossed irregular surface, said opposed side walls having an irregular longitudinally shaped flat side surface, all of said side walls having spaced-apart protruding sections of irregular transverse cross-section which extend to straight intersecting outer parallel axes of said side walls, all of said side walls having recessed sections of irregular transverse cross-section defined between said protruding sections, said protruding sections and said recessed sections extending from said top and bottom walls and being of substantially uniform cross-section throughout, said protruding sections and recessed sections in each said side walls having a different cross-sectional shape, said outer parallel axes defining a rectangular outer peripheral boundary of said concrete body whereby a plurality of said cobblestones can be laid on a support surface in substantially straight aligned relationship to define a pavement, said cobblestones being offset end-to-end at irregular intervals and irregularly interlocked by some of said protruding sections of some of said cobblestones entering into said irregular recessed sections of other of said cobblestones to prevent shifting of said cobblestones in said pavement, at least some of said projections being configured to enter into two or more of said recessed sections of an adjacent cobblestone, said projections having different cross-sectional shapes, said recessed sections defining irregular shaped open crevices between said side walls of said cobblestones when laid in side-by-side and offset relationship.

2. A pre-cast cobblestone as claimed in claim 1 wherein there are two or more of said spaced-apart protruding sections in said at least two of said side walls.

3. A pre-cast cobblestone as claimed in claim 1 wherein said width is of 140 mm and said length of said four different sizes being 160 mm, 200 mm, 240 mm and 280 mm, respectively.

* * * * *